US010393119B2

(12) United States Patent
Ishizono et al.

(10) Patent No.: US 10,393,119 B2
(45) Date of Patent: Aug. 27, 2019

(54) FLUID COMPRESSOR HAVING DISCHARGE VALVE AND VALVE RETAINER

(71) Applicant: Mitsubishi Electric Corporation, Tokyo (JP)

(72) Inventors: Fumihiko Ishizono, Tokyo (JP); Masayuki Kakuda, Tokyo (JP); Kohei Tatsuwaki, Tokyo (JP); Yuji Takamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 205 days.

(21) Appl. No.: 15/311,545

(22) PCT Filed: Jul. 1, 2014

(86) PCT No.: PCT/JP2014/067577
§ 371 (c)(1),
(2) Date: Nov. 16, 2016

(87) PCT Pub. No.: WO2016/002013
PCT Pub. Date: Jan. 7, 2016

(65) Prior Publication Data
US 2017/0097002 A1 Apr. 6, 2017

(51) Int. Cl.
*F04B 39/10* (2006.01)
*F04C 18/02* (2006.01)
(Continued)

(52) U.S. Cl.
CPC ..... *F04C 29/124* (2013.01); *F04B 39/10* (2013.01); *F04B 39/1073* (2013.01);
(Continued)

(58) Field of Classification Search
CPC ..... F04C 29/124; F04C 29/128
See application file for complete search history.

(56) References Cited

U.S. PATENT DOCUMENTS 7,080,522 B2 * 7/2006 Taira ..... F04C 23/008 62/244
7,160,088 B2 * 1/2007 Peyton ..... F04C 29/128 418/55.1
(Continued)

FOREIGN PATENT DOCUMENTS

JP 3055731 U 1/1999
JP 2002-005057 A 1/2002
(Continued)

OTHER PUBLICATIONS

International Search Report of the International Searching Authority dated Sep. 30, 2014 for the corresponding (International application No. PCT/JP2014/067577 (and English translation).
(Continued)

*Primary Examiner* — Mary Davis
(74) *Attorney, Agent, or Firm* — Posz Law Group, PLC

(57) ABSTRACT

A fluid compressor includes a closed container having an inlet, a compression mechanism including a compression chamber in which fluid flowing into the closed container through the inlet is compressed, a discharge port through which the fluid compressed in the compression chamber is allowed to flow, a discharge valve opening and closing the discharge port, and a valve retainer limiting an amount of lift of the discharge valve. The discharge valve includes a curved portion whose shape is defined by one or more curvatures. When the discharge port is closed by the discharge valve, the valve retainer and the discharge valve are spaced apart from each other.

8 Claims, 5 Drawing Sheets

(51) Int. Cl.
*F04C 23/00* (2006.01)
*F04C 29/12* (2006.01)

(52) U.S. Cl.
CPC ..... *F04C 18/0215* (2013.01); *F04C 29/128* (2013.01); *F04C 23/008* (2013.01); *F04C 2210/263* (2013.01); *F04C 2210/268* (2013.01)

(56) References Cited

U.S. PATENT DOCUMENTS

| | | | | |
|---|---|---|---|---|
| 9,624,413 | B2 * | 4/2017 | Fukushima | C09K 5/045 |
| 2014/0166923 | A1 * | 6/2014 | Yana Motta | C09K 3/30 252/68 |
| 2015/0211520 | A1 * | 7/2015 | Otsuka | F04C 29/128 418/259 |

FOREIGN PATENT DOCUMENTS

| | | | |
|---|---|---|---|
| JP | 2002-005058 | A | 1/2002 |
| JP | 2003-028060 | A | 1/2003 |
| JP | 4189751 | B | 12/2008 |
| JP | 2014-098166 | A | 5/2014 |
| JP | 2014-118954 | A | 6/2014 |

OTHER PUBLICATIONS

Office Action dated Sep. 5, 2017 issued in corresponding JP patent application No. 2016-530733 (and English translation).

* cited by examiner

FLUID COMPRESSOR HAVING DISCHARGE VALVE AND VALVE RETAINER

CROSS REFERENCE TO RELATED APPLICATION

This application is a U.S. national stage application of International Application No. PCT/JP2014/067577 filed on Jul. 1, 2014, the disclosure of which is incorporated herein by reference.

TECHNICAL FIELD

The present invention relates to a fluid compressor.

BACKGROUND ART

A scroll compressor is known in which a discharge valve for a high-pressure space of a chamber is provided in a closed container (see Patent Literature 1, for example).

CITATION LIST

Patent Literature

Patent Literature 1: Japanese Patent No. 4189751 (pages 3 and 4, FIG. 1)

SUMMARY OF INVENTION

Technical Problem

A discharge valve prevents gas discharged from a helix from flowing back into the helix. Such discharge valves are roughly categorized into two types. One of the two types of discharge valves is a float-type valve (a float valve) that is freely movable in a space and is not fixed. The other of the two types of discharge valves is a cantilever-type valve (a reed valve) with one end fixed. The two types of discharge valves are different in the direction of discharge, in the discharging area, and in the valve-closing speed. Consequently, an appropriate discharge valve is employed depending on the flow rate of discharge of refrigerant and pressure conditions.

However, the behavior of the float valve is unstable, thus the float valve is rarely employed. On the other hand, the reed valve has at least one of two ends fixed to a closed container. Hence, the behavior of the reed valve is more stable than the behavior of the float valve. Furthermore, the reed valve rarely causes a delay in the closing action and can prevent the backflow. In a case where the reed valve is provided in a fluid compressor, however, when the cross-sectional area of a passage at a discharge port that allows refrigerant compressed in a compression chamber to flow through the discharge port is increased, the length of the reed valve needs to be increased. Consequently, in a compressor including a small closed container, providing a reed valve in the closed container is difficult.

A fluid compressor including a reed valve is provided with a valve retainer. The valve retainer limits the amount of lift of the reed valve and the curvature of the reed valve, thereby reducing the stress occurring in the reed valve. Hence, providing a valve retainer prevents the excessive lifting of the reed valve that may break the reed valve from the base. The shape of the valve retainer is determined so that the bending stress occurring in the reed valve when the reed valve is lifted along the curve of the valve retainer is smaller than or equal to an allowable stress. The amount of lift of the reed valve is defined by the length of the reed valve from the fixed part to the tip to be lifted and the allowable curvature of the reed valve.

When a reed valve and a valve retainer are provided in a limited space in a closed container included in a fluid compressor, the reed valve cannot have a satisfactory length. Thus, the amount of lift of the reed valve is naturally small. Consequently, the fluid compressed in a compression chamber is discharged from a narrow discharge passage. That is, the refrigerant compressed in the compression chamber and discharged from the compression chamber flows through the narrow discharge passage, thus the pressure loss increases. Consequently, the pressure increases extraordinarily on the upstream side of the discharge valve. When the refrigerant is compressed with the extraordinarily high pressure on the upstream side of the discharge valve, the temperature of the refrigerant tends to rise. Consequently, the reliability of the compressor may be lowered.

When R32 refrigerant or a refrigerant mixture containing R32 refrigerant by 51% or higher is used, the pressure of the refrigerant tends to become higher, because of its characteristics, even within a range of normal use, than in a case where R410A refrigerant containing R32 refrigerant by 50% is used. Consequently, in a fluid compressor configured as described above, the pressure of the refrigerant is more likely to increase. Furthermore, in the case where R32 refrigerant or a refrigerant mixture containing R32 refrigerant by 51% or higher is used, the temperature of the refrigerant is generally higher by 10 to 30 degrees C. than the discharge temperature of the R410A refrigerant containing R32 refrigerant by 50%

Hence, when the discharge pressure or the discharge temperature tends to become high in the case where R32 refrigerant or a refrigerant mixture containing R32 refrigerant by 51% or higher is used, the discharge pressure or the discharge temperature may be detected, and, on the basis of the result of such detection, the compressor may be controlled to be operated so that the discharge pressure or the discharge temperature does not exceed a predetermined level, thus the reliability of the compressor may be maintained. However, when the operation of the compressor is restricted on the basis of the detected discharge pressure or discharge temperature in the case where R32 refrigerant or a refrigerant mixture containing R32 refrigerant by 51% or higher is used, the compressor cannot operate as satisfactorily as in the case where R410A refrigerant is used. Such a problem occurs because as the percentage of R32 refrigerant becomes higher, the pressure of the compressed refrigerant tends to become higher, and the temperature of the refrigerant tends to increase.

When a refrigerant containing carbon double bonds, such as HFO-1234yf refrigerant and HFO-1234ze refrigerant, or a refrigerant mixture containing such a refrigerant by 30% or higher is used, the amount of refrigerant to be circulated needs to be increased to 2- to 2.5-fold to obtain substantially the same level of cooling effect as that obtained by R410A refrigerant. However, when the amount of refrigerant to be circulated is increased, the speed of the refrigerant flowing through the discharge valve is increased, thus increasing the pressure loss. When the pressure loss increases, the pressure extraordinarily increases on the upstream side of the discharge valve, thus extraordinarily raises the discharge temperature. Alternatively, HFO-1123 refrigerant, which is a refrigerant containing carbon double bonds, is highly flammable and is thus used by being mixed with a less flammable refrigerant. When HFO-1123 refrigerant is to be mixed with another refrigerant containing carbon double bonds, such as HFO-1234yf refrigerant and HFO-1234ze refrigerant, or with R32 refrigerant, the mixture containing HFO-1123 by 70% or lower can be safely used. However, when the discharge temperature of such a refrigerant mixture rises, the stability of the refrigerant tends to be reduced.

Hence, when the discharge pressure or the discharge temperature of the refrigerant tends to become high in the case where a refrigerant containing carbon double bonds, such as HFO-1234yf refrigerant and HFO-1234ze refrigerant, is used, the discharge pressure or the discharge temperature may be detected, and, on the basis of the result of such detection, the compressor may be controlled to be operated so that the discharge pressure or the discharge temperature does not exceed a predetermined level, thus the reliability of the compressor may be maintained. However, when the operation of the compressor is restricted on the basis of the result of detected discharge pressure or discharge temperature in the case where a refrigerant containing carbon double bonds, such as HFO-1234yf refrigerant and HFO-1234ze refrigerant, is used, the compressor cannot operate as satisfactorily as in the case where R410A refrigerant is used, In view of the above, an object of the present invention is to provide a compact fluid compressor in which the pressure loss at the discharge valve is reduced.

Solution to Problem

A fluid compressor according to an embodiment of the present invention includes a closed container having an inlet, a compression mechanism including a compression chamber in which fluid flowing into the closed container through the inlet is compressed, a discharge port through which the fluid compressed in the compression chamber is allowed to flow, a discharge valve opening and closing the discharge port, and a valve retainer limiting an amount of lift of the discharge valve. The discharge valve includes a curved portion whose shape is defined by one or more curvatures. When the discharge port is closed by the discharge valve, the valve retainer and the discharge valve are spaced apart from each other.

Advantageous Effects of Invention

In the fluid compressor according to the embodiment of the present invention, the discharge valve includes the curved portion whose shape is defined by one or more curvatures. Consequently, the discharge valve can be made shorter than in a case of a discharge valve having a straight line shape. Hence, a greater amount of lift can be provided than in the case of the discharge valve having the straight line shape. Thus, the pressure loss can be reduced. In addition, the size can be more reduced than in the case of the discharge valve having the straight line shape.

DESCRIPTION OF EMBODIMENTS

Scroll compressors as exemplary fluid compressors 100 according to the present invention will be described below. The following configurations, operations, and other associated matter are only exemplary, and the configurations, operations, and other associated matter of the fluid compressors 100 according to the present invention are not limited to the examples. In each of the drawings, the same or similar members or portions are denoted by common reference signs, and details are simplified or omitted appropriately. Redundant or similar description is also simplified or omitted appropriately.

Embodiment 1

Figure 1:
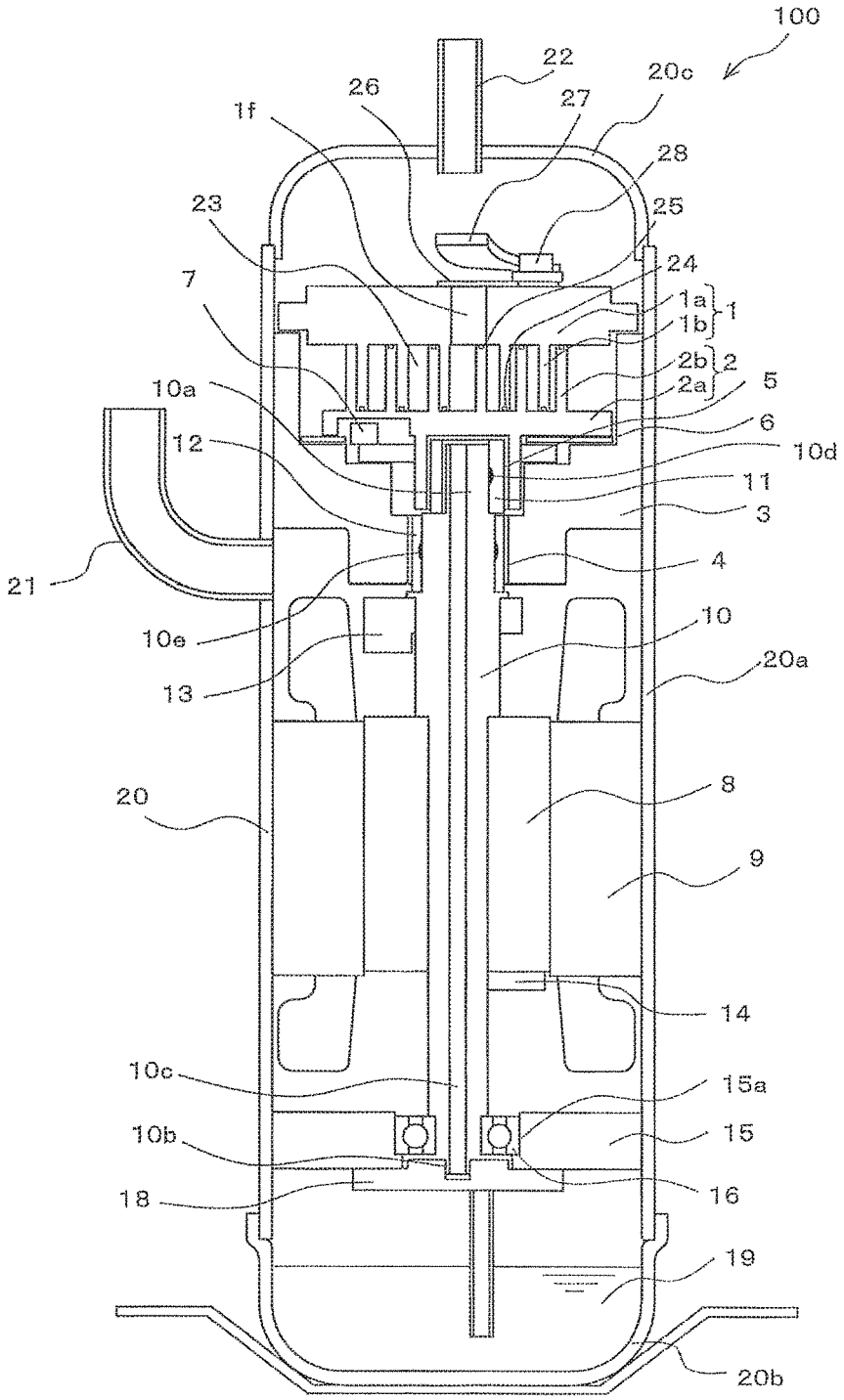
FIG. 1 is a vertical sectional view of a fluid compressor 100 according to Embodiment 1 of the present invention.

FIG. 1 is a vertical sectional view of a fluid compressor 100 according to Embodiment 1 of the present invention. As illustrated in FIG. 1, the fluid compressor 100 includes a fixed scroll 1, an orbiting scroll 2, a frame 3, a main bearing 4, an orbiting bearing 5, a thrust plate 6, an Oldham ring 7, an electric-motor rotor 8, an electric-motor stator 9, a main shaft (crank shaft) 10, an eccentric shaft portion 10*a*, a pump shaft 10*b*, an oil hole 10*c*, pivot portions 10*d* and 10*e*, a slider 11, a sleeve 12, an upper balance-weight portion 13, a lower balance-weight portion 14, a sub-frame 15, a sub-bearing 16, an oil pump 18, an oil sump 19, a closed-container middle 20*a*, a closed-container bottom 20*b*, a closed-container top 20*c*, seals 24 and 25, a discharge valve 26, a valve retainer 27, and a bolt 28.

The fixed scroll 1 includes an end plate 1*a*, and a first helical portion 1*b* extending from the end plate 1*a*. The fixed scroll 1 has a discharge port 1*f*. The discharge port 1*f* is provided at substantially the center of a surface (the upper surface of the fixed scroll 1) that does not form the helix of the fixed scroll 1. The seal 24 is provided at an end surface of the first helical portion 1*b* of the fixed scroll 1.

The orbiting scroll 2 includes an end plate 2*a*, and a second helical portion 2*b* extending from the end plate 2*a*. The orbiting scroll 2 houses a key portion (not illustrated) of the Oldham ring 7. The seal 25 is provided at an end surface of the second helical portion 2*b* of the orbiting scroll 2. The whirling direction of the second helical portion 2*b* is opposite to the whirling direction of the first helical portion 1*b*.

The fixed scroll 1 and the orbiting scroll 2 form a compression mechanism of the fluid compressor 100. When the orbiting scroll 2 moves orbitally, a centrifugal force acts on the orbiting scroll 2. Thus, the orbiting scroll 2 slides in a slidable area defined between the eccentric shaft portion 10*a* of the main shaft 10 and a sliding surface 11*a* on the inner side of the slider 11. Then, the second helical portion 2*b* of the orbiting scroll 2 and the first helical portion 1*b* of the fixed scroll 1 come into contact with and mesh with each other, thus forming a compression chamber 23.

The frame 3 is provided for fixing the fixed scroll 1 and is fixed to a closed container 20. The frame 3 includes the main bearing 4 that bears the rotation of the main shaft 10. The main bearing 4 is provided at, for example, the center of the frame 3. The orbiting bearing 5 is provided at, for example, the rear center of the end plate 2*a* of the orbiting scroll 2. The thrust plate 6 serves as a thrust bearing that bears the orbiting scroll 2 in the axial direction. The thrust plate 6 is provided on a thrust bearing portion of the frame 3. The Oldham ring 7 prevents the orbiting scroll 2 from rotating on its own axis and allows the orbiting scroll 2 to move orbitally. The electric-motor rotor 8 and the electric-motor stator 9 form an electric motor.

The main shaft 10 is a shaft that is rotated by the electric motor and is provided at, for example, the center of the frame 3. The eccentric shaft portion 10*a* is a slider-attaching shaft provided at the top of the main shaft 10 so that the slider 11 is eccentric to the main shaft 10. The eccentric shaft portion 10*a* is provided with the pivot portion 10*d*. The pump shaft 10*b* transmits a rotational force to the oil pump 18 and is integrated with the main shaft 10. The main shaft 10 also has the oil hole 10*c* extending through the center of the main shaft 10 from the lower end of the pump shaft 10*b* to the upper end of the main shaft 10.

The slider 11 bears the orbiting scroll 2 to allow the orbiting scroll 2 to move orbitally. The sleeve 12 is provided in the vicinity of the eccentric shaft portion 10*a* and allows the main bearing 4 and the main shaft 10 to rotationally move smoothly. The upper balance-weight portion 13 and the lower balance-weight portion 14 offset the unbalance between the orbiting scroll 2 moved orbitally by the eccentric shaft portion 10*a* of the main shaft 10 and the center of rotation of the main shaft 10.

The sub-frame 15 is fixed in the closed container 20 and is provided at the bottom of the eccentric shaft portion 10*a*. A bearing-receiving portion 15*a* is provided at the center of the sub-frame 15. The sub-frame 15 is provided with the oil pump 18 that is of a displacement type. The outer ring of the sub-bearing 16 is press-fitted in and is secured in the bearing-receiving portion 15*a*. The oil pump 18 communicates with the oil hole 10*c* at the lower end of the main shaft 10.

The closed-container middle 20*a*, the closed-container bottom 20*b*, and the closed-container top 20*c* form a container that houses various members of the fluid compressor 100. The closed-container middle 20*a* secures the frame 3 at the top end and supports the electric-motor stator 9 in a middle part. The closed-container middle 20*a* has an inlet 21. The closed-container bottom 20*b* has the oil sump 19 at the bottom. The oil sump 19 is positioned in a space into which refrigerant having a relatively low temperature sucked into the closed-container middle 20*a*, the closed-container bottom 20*b*, and the closed-container top 20*c* flows. The oil sump 19 is filled with lubricating oil that lubricates the bearings. The closed-container top 20*c* has an outlet 22. The combination of the closed-container middle 20*a*, the closed-container bottom 20*b*, and the closed-container top 20*c* as a whole has, for example, a cylindrical shape.

Hereinafter, the closed-container middle 20*a*, the closed-container bottom 20*b*, and the closed-container top 20*c* are also collectively referred to as the closed container 20. The closed container 20 may alternatively be divided into smaller members or a more number of members, instead of being divided into three members, or may be provided as one integral body.

The inlet 21 is an opening for sucking the refrigerant flowing into a refrigerant pipe on a suction side of the fluid compressor 100 into the closed container 20. The inlet 21 is provided in the vicinity of a suction port of the frame 3, the electric-motor rotor 8, and the electric-motor stator 9. The outlet 22 is an opening for discharging the refrigerant compressed in the closed container 20 to the outside of the closed container 20.

Figure 2:
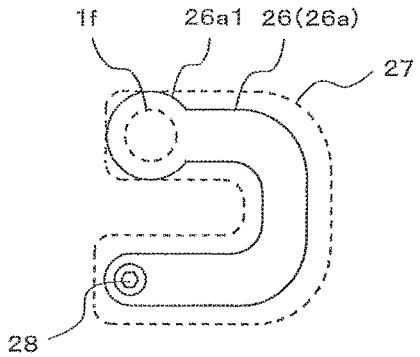
FIG. 2 is a top projection view of a discharge valve 26 and a valve retainer 27 included in the fluid compressor 100 according to Embodiment 1 of the present invention.

FIG. 2 is a top projection view of the discharge valve 26 and the valve retainer 27 included in the fluid compressor 100 according to Embodiment 1 of the present invention. As illustrated in FIG. 2, the discharge valve 26 is a valve body including a curved portion 26*a* whose shape is defined by one or more curvatures. Specifically, the discharge valve 26 has, for example, a U shape or a substantially U shape and is fixed to the upper surface of the fixed scroll 1. The discharge valve 26 is made of, for example, highly elastic valve steel or stainless steel. The discharge valve 26 has a closing portion 26*a*1 at one end. The closing portion 26*a*1 is shaped to be able to close the discharge port 1*f*. The closing portion 26*a*1 has a shape swelling outward in the widthwise direction of the curved portion 26*a*. The other end of the discharge valve 26 is fixed to a compression mechanism (for example, the fixed scroll 1) with the bolt 28. The valve retainer 27 is provided above the discharge valve 26.

Hereinafter, the end of the discharge valve 26 that closes the discharge port 1*f* is also referred to as the free end of the discharge valve 26. Hereinafter, the other end of the discharge valve 26 that is fixed to the fixed scroll 1 with the bolt 28 is also referred to as the fixed end of the discharge valve 26.

As illustrated in FIG. 2, the valve retainer 27 has, for example, a substantially the same shape as the plan-view shape of the discharge valve 26, for example, a U shape or a substantially U shape. The contour of the valve retainer 27 in plan view is on the outer side of the contour of the discharge valve 26 in plan view. For example, the valve retainer 27 covers the entirety of the upper surface of the discharge valve 26. The valve retainer 27 is formed to define the amount of lift of the discharge valve 26. For example, the height of the valve retainer 27 defines the amount of lift of the discharge valve 26.

The valve retainer 27 is made of, for example, a material that is highly strong and highly tough. Hence, when the discharge valve 26 opens the discharge port 1*f* and warps upward to collide with the valve retainer 27 or when the valve retainer 27 receives a load caused by the jetted refrigerant gas, the probability that the valve retainer 27 is damaged can be reduced, Herein, the "material that is highly strong and highly tough" is, for example, stainless steel.

In a state where the discharge valve 26 closes the discharge port 1*f*, the discharge valve 26 and the valve retainer 27 are spaced apart from each other. In a state where the discharge valve 26 opens the discharge port 1*f*, the discharge valve 26 and the valve retainer 27 are spaced apart from or in contact with each other. When the discharge valve 26 and the valve retainer 27 come into contact with each other, the amount of lift of the discharge valve 26 is limited.

Hereinafter, one end of the valve retainer 27 that is positioned above the free end of the discharge valve 26 is also referred to as the free end of the valve retainer 27. Hereinafter, the other end of the valve retainer 27 that is positioned above the fixed end of the discharge valve 26 is also referred to as the fixed end of the valve retainer 27.

The valve retainer 27 may be formed to curve gently from the fixed end to the free end of the valve retainer 27. Thus, in the state where the discharge valve 26 opens the discharge port 1*f*, the discharge valve 26 is easily in close contact with the valve retainer 27.

The discharge valve 26 may be coated or nitrided. Thus, even when the discharge valve 26 collides with the fixed scroll 1 or the valve retainer 27, the discharge valve 26 is less likely to wear.

Figure 3:
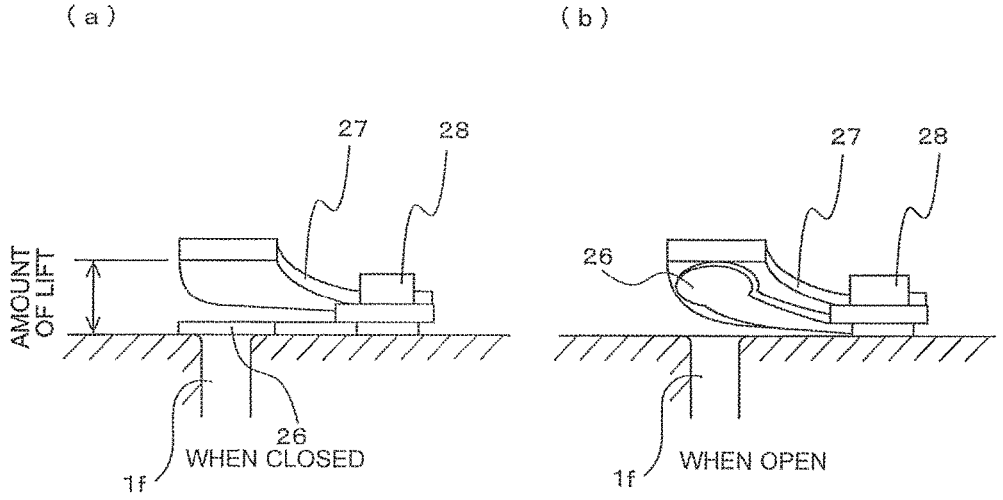
FIG. 3 includes side views of the discharge valve 26 of the fluid compressor 100 according to Embodiment 1 of the present invention closing and opening a discharge port 1*f*.

FIG. 3 includes side views of the discharge valve 26 of the fluid compressor 100 according to Embodiment 1 of the present invention closing and opening the discharge port 1*f*. FIG. 3(*a*) is the side view of the discharge valve 26 of the fluid compressor 100 according to Embodiment 1 of the present invention closing the discharge port 1*f*. FIG. 3(*b*) is the side view of the discharge valve 26 of the fluid compressor 100 according to Embodiment 1 of the present invention opening the discharge port 1*f*.

Before the fluid flowing in the closed container 20 is compressed in the compression chamber 23, the discharge port 1*f* is closed by the discharge valve 26 as illustrated in FIG. 3(*a*). After the fluid flowing in the closed container 20 is compressed in the compression chamber 23, the fluid compressed in the compression chamber 23 flows through the discharge port 1*f*. Then, as illustrated in FIG. 3(*b*), the discharge valve 26 warps along the curve of the valve retainer 27, thereby opening the discharge port 1*f*.

The curvature of the valve retainer 27 is determined so that the stress to be applied to the discharge valve 26 is equal to or lower than the allowable stress of the material forming the discharge valve 26. The amount of lift defined by the shape of the valve retainer 27 is set to be as large as possible within a range corresponding to the above curvature so that the resistance of the compressed gas flowing out of the discharge port 1*f* can be made as small as possible.

The operation of the fluid compressor 100 according to Embodiment 1 will be described below.

When power is supplied to the electric-motor stator 9, the main shaft 10 is rotated by the electric-motor rotor 8. The rotational power is transmitted through the slider 11 housing the eccentric shaft portion 10*a* to the inside of the orbiting bearing 5 and then to the orbiting scroll 2. Then, the Oldham ring 7 reciprocatingly moves between an Oldham groove (not illustrated) of the orbiting scroll 2 and an Oldham groove (not illustrated) of the frame 3. Hence, the rotation of the orbiting scroll 2 is prevented, and the orbiting scroll 2 moves orbitally.

Variations in the accuracy that may occur when the frame 3 and the sub-frame 15 are fixed to the closed container 20 and variations in the accuracy of each of associated components cause the misalignment between the main bearing 4 and the sub-bearing 16. Furthermore, the main shaft 10 may bend, thus the main bearing 4 and the sub-bearing 16 do not necessarily become parallel to the main shaft 10. Consequently, the sleeve 12 is provided between the main shaft 10 and the main bearing 4 so that the sliding surface on the inner side of the main bearing 4 extends parallel to the main shaft 10 and the sub-bearing 16. Hence, for example, when the misalignment occurs between the main bearing 4 and the sub-bearing 16 and the main shaft 10 is tilted to the main bearing 4, the pivot portion 10*e* of the main shaft 10 comes into contact with the inner peripheral surface of the sleeve 12 and absorbs the tilt of the main shaft 10. Thus, the outer periphery of the sleeve 12 slides along the main bearing 4 always parallelly.

Furthermore, the load generated by the centrifugal force of the orbiting scroll 2 and the load generated when the refrigerant is compressed and acting in the radial direction are applied to the eccentric shaft portion 10*a* of the main shaft 10, thus the eccentric shaft portion 10*a* bends. Consequently, the eccentric shaft portion 10*a* does not necessarily extend parallel to the inner surface of the orbiting bearing 5. To make the sliding surface of the orbiting bearing 5 to extend parallel to the eccentric shaft portion 10*a* of the main shaft 10, the slider 11 is provided between the eccentric shaft portion 10*a* of the main shaft 10 and the orbiting bearing 5. Consequently, for example, when the eccentric shaft portion 10*a* bends and is tilted to the orbiting bearing 5, the pivot portion 10*d* comes into contact with the slider surface (not illustrated) of the slider 11 and absorbs the tilt of the eccentric shaft portion 10*a*. Thus, the outer periphery of the slider 11 slides along the orbiting bearing 5 always parallelly.

The flow of refrigerant and the flow of refrigerating machine oil will be described below.

The refrigerant in a refrigerant circuit is introduced into the closed container 20 through the inlet 21 and flows into the compression chamber 23 through the suction port (not illustrated) of the frame 3. Furthermore, the lubricating oil pumped up by the oil pump 18 is supplied to associated sliding points through the oil hole 10*c* of the main shaft 10 and flows into the compression chamber 23. Exemplary sliding points are listed below from (1) to (7).

(1) The point between the end plate 2*a* of the orbiting scroll 2 and the thrust plate 6

(2) The point between the side surface of the first helical portion 1*b* of the fixed scroll 1 and the side surface of the second helical portion 2*b* of the orbiting scroll 2

(3) The points between the seal 24 of the fixed scroll 1 and bottom lands of the end plate 2*a* of the orbiting scroll 2, the bottom lands each provided between adjacent teeth of the second helical portion 2*b*

(4) The points between the seal 25 of the orbiting scroll 2 and bottom lands of the end plate 1*a* of the fixed scroll 1, the bottom lands each provided between adjacent teeth of the first helical portion 1*b*

(5) The point between a projection of the Oldham ring 7 and a groove provided in the frame 3

(6) The point between the projection of the Oldham ring 7 and a groove provided in the end plate 2*a* of the orbiting scroll 2

(7) The point between the orbiting bearing 5 and the outer peripheral surface of the slider 11, and the point between the main bearing 4 and the outer peripheral surface of the sleeve 12

The lubricating oil lubricates the point between the end plate 2*a* of the orbiting scroll 2 and the thrust plate 6 and overflows to a side of the end plate 2*a* of the orbiting scroll 2 on which the second helical portion 2*b* is provided. The lubricating oil overflowed to the surface of the end plate 2*a* of the orbiting scroll 2 on which the second helical portion 2*b* is provided flows into the compression chamber 23 together with the refrigerant flowing from the suction port of the frame 3. The lubricating oil flowed into the compression chamber 23 is used at, for example, the following sliding points (a) to (c).

(a) The point between the side surface of the first helical portion 1*b* of the fixed scroll 1 and the side surface of the second helical portion 2*b* of the orbiting scroll 2

(b) The points between the seal 24 of the fixed scroll 1 and bottom lands of the end plate 2*a* of the orbiting scroll 2, the bottom lands each provided between adjacent teeth of the second helical portion 2*b*

(c) The points between the seal 25 of the orbiting scroll 2 and bottom lands of the end plate 1*a* of the fixed scroll 1, the bottom lands each provided between adjacent teeth of the first helical portion 1*b*

At the above sliding points (a) to (c), the temperature rises with the sliding motion. The sliding points where the temperature rises with the sliding motion are positioned in a space into which refrigerant having a relatively low temperature sucked into the closed container 20 flows. Consequently, the sliding points where the temperature has risen with the sliding motion is cooled by the refrigerant sucked into the closed container 20. The electric-motor rotor 8, the electric-motor stator 9, and other associated components are also cooled by the relatively low-temperature refrigerant sucked into the closed container 20. The refrigerating machine oil that has lubricated the sliding points is also cooled by the relatively low-temperature refrigerant sucked into the closed container 20 in the oil sump 19.

Meanwhile, when the power is supplied to the electric-motor stator 9, the main shaft 10 and the electric-motor rotor 8 are rotated. The power is supplied from, for example, a commercial power supply at 50 Hz or 60 Hz. To make the amount of refrigerant to be circulated variable, an inverter power supply capable of operating at a rotation speed of driving that is variable within the range of 600 rpm to 15000 rpm may be used.

When the main shaft 10 is driven and rotated, the main shaft 10 rotates together. The eccentric shaft portion 10*a* rotates in the orbiting bearing 5. Furthermore, the orbiting scroll 2 is prevented from rotating on its own axis by the Oldham ring 7. Consequently, only the rotational motion of the eccentric shaft portion 10*a* is transmitted to the orbiting scroll 2. When the orbiting scroll 2 rotationally moves, the refrigerant and the lubricating oil flowed into the compression chamber 23 move toward the centers of the fixed scroll 1 and the orbiting scroll 2. The refrigerant and the lubricating oil flowed into the compression chamber 23 are compressed because the compression chamber 23 changes its shape and comes to have a reduced volume. In this step, the compressed refrigerant generates a load that moves the fixed scroll 1 and the orbiting scroll 2 away from each other in the axial direction. The load is borne by a bearing formed by the thrust plate 6 from a surface of the end plate 2*a* of the orbiting scroll 2 that is opposite to the surface on which the second helical portion 2*b* is provided.

The refrigerant and the lubricating oil compressed in the compression chamber 23 flow through the discharge port 1*f* and thus push up the discharge valve 26. Thus, the discharge valve 26 opens the discharge port 1*f*. In this state, the discharge valve 26 is elastically deformed by the jet stream of the refrigerant to extend along the valve retainer 27. The refrigerant and the lubricating oil passing through the discharge port 1*f* flow through the high-pressure part of the closed container 20 and the outlet 22 in this order and are discharged to the outside of the closed container 20. The refrigerant and the lubricating oil discharged from the outlet 22 to the outside of the closed container 20 flow through the refrigerant circuit (not illustrated) and flow into the closed container 20 again through the inlet 21.

When the fluid compressor 100 is not in operation, the discharge port 1*f* is closed by the discharge valve 26 with the elastic force of the discharge valve 26. When a pressure difference lies between the upstream side and the downstream side of the discharge port 1*f*, the pressure difference is added to the force of pressing the discharge valve 26 against the closing portion 26*a*1, thus the discharge port 1*f* is closed. When the fluid compressor 100 is in operation, the discharge valve 26 may repeatedly close and open the discharge port 1*f*, depending on the pressure difference between the upstream side and the downstream side of the discharge valve 26.

As described above, the fluid compressor 100 according to Embodiment 1 includes the discharge valve 26 having a U shape or a substantially U shape. Consequently, the length of the valve retainer 27 from the fixed end to the free end can be made long. Hence, the curvature of the discharge valve 26 can be made large, and the amount of lift of the discharge valve 26 can also be made large. In particular, when the discharge valve 26 is shaped as illustrated in FIG. 2, the discharge valve 26 can have an amount of lift that is about two-fold with the same length (space). Thus, a compact fluid compressor 100 with a reduced pressure loss can be obtained.

In Embodiment 1, the diameter of the cylindrical closed container 20 is determined by the size of the motor and the strength against the pressure. Hence, the designed amount of lift of the discharge valve 26 can be optimized in consideration that the discharge valve 26 is housed in the closed container 20. Consequently, the pressure loss in the vicinity of the discharge valve 26 can be reduced.

The pressure loss can be reduced as described above, thus costs do not significantly increase even when any of the following refrigerants is used: refrigerant containing carbon double bonds and tending to flow at a high speed and to cause a large pressure loss, such as HFO-1234yf refrigerant and HFO-1234ze refrigerant; a refrigerant mixture containing refrigerant containing carbon double bonds, such as HFO-1234yf refrigerant, by 30% or higher, and tending to flow at a high speed and to cause a large pressure loss; a refrigerant mixture containing HFO-1123 refrigerant required to be controlled under operational restrictions because the discharge temperature tends to be high by 70% or lower; a refrigerant mixture containing R32 refrigerant; and a refrigerant mixture containing R32 refrigerant by 51% or higher.

The fluid used in the fluid compressor 100 is not limited to a specific fluid. When a refrigerant is used as the fluid, a greater effect of the fluid can be obtained by a refrigerant mixture containing HFC-based R32 refrigerant whose ozone depletion potential is zero, or a refrigerant mixture containing R32 refrigerant by 51% or higher. This is because the pressure of HFC-based R32 refrigerant whose ozone depletion potential is zero or a refrigerant mixture containing R32 refrigerant by 51% or higher easily increases, thus the temperature of such a refrigerant easily rises.

"A refrigerant mixture containing R32 refrigerant by 51% or higher" refers to, for example, a refrigerant mixture obtained by mixing R32 with any of the following: HFC refrigerant whose ozone depletion potential is zero, halogenated hydrocarbon containing carbon double bonds in its refrigerant composition, and hydrocarbon. "HFC refrigerant whose ozone depletion potential is zero" refers to, for example, R125 or R161. "Halogenated hydrocarbon containing carbon double bonds" refers to, for example, fluorocarbon-based low-GWP refrigerant whose ozone depletion potential is zero and whose global warming potential GWP is small, such as HFO-1123, HFO-1234yf, HFO-1234ze, and HFO-1243zf. "Hydrocarbon" refers to, for example, natural refrigerant such as propane and propylene.

Fluorocarbon-based low-GWP refrigerant such as HFO-1234yf, HFO-1234ze, and HFO-1243zf flows at a refrigerant flow rate of about 2 to 2.5 times the flow rate in a case where HFC-based refrigerant is used. Hence, when the amount of lift of the discharge valve 26 is small, a large pressure loss occurs. In contrast, according to Embodiment 1, the amount of lift can be made large. Consequently, a greater effect is obtained particularly in a case where refrigerant such as HFO-1234yf, HFO-1234ze, and HFO-1243zf is used. The same also applies to a case where hydrocarbon such as propane and propylene, which is natural refrigerant, is used.

Alternatively, a refrigerant mixture containing fluorocarbon-based low-GWP refrigerant such as HFO-1234yf, HFO-1234ze, and HFO-1243zf by 30% or higher may be used. For example, HFC refrigerant whose ozone depletion potential is zero is to be mixed with fluorocarbon-based low-GWP refrigerant. Here, HFC refrigerant refers to, for example, R32, R125, or R161. The same applies to a case where a refrigerant mixture containing HFO-1123 refrigerant by 70% or lower is used. The refrigerant to be mixed with HFO-1123 refrigerant composing 70% or lower of the mixture is "halogenated hydrocarbon containing carbon double bonds" or "HFC refrigerant whose ozone depletion potential is zero" such as R32.

Embodiment 2

Embodiment 2 differs from Embodiment 1 in that the discharge valve 26 has a helical shape and the valve retainer 27 has a helical shape.

Figure 4:
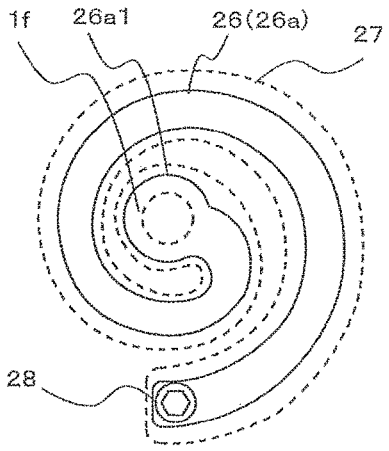
FIG. 4 is a top projection view of a discharge valve 26 and a valve retainer 27 of a fluid compressor 100 according to Embodiment 2 of the present invention.

FIG. 4 is a top projection view of a discharge valve 26 and a valve retainer 27 of a fluid compressor 100 according to Embodiment 2 of the present invention. As illustrated in FIG. 4, the discharge valve 26 has a helical or substantially helical shape.

The free end of the discharge valve 26 has a closing portion 26*a*1, The closing portion 26*a*1 is shaped to be able to close the discharge port 1*f*. The closing portion 26*a*1 has, for example, a shape swelling outward in the widthwise direction of the curved portion 26*a*. The fixed end of the discharge valve 26 is fixed to the fixed scroll 1 with a bolt 28. The valve retainer 27 is provided above the discharge valve 26.

As illustrated in FIG. 4, the valve retainer 27 has, for example, substantially the same shape as the plan-view shape of the discharge valve 26, for example, a helical or a substantially helical shape. The contour of the valve retainer 27 in plan view is on the outer side of the contour of the discharge valve 26 in plan view. For example, the valve retainer 27 covers the entirety of the upper surface of the discharge valve 26. The valve retainer 27 is shaped to gently slope toward the center of the valve retainer 27 (toward the free end of the valve retainer 27).

Figure 5:
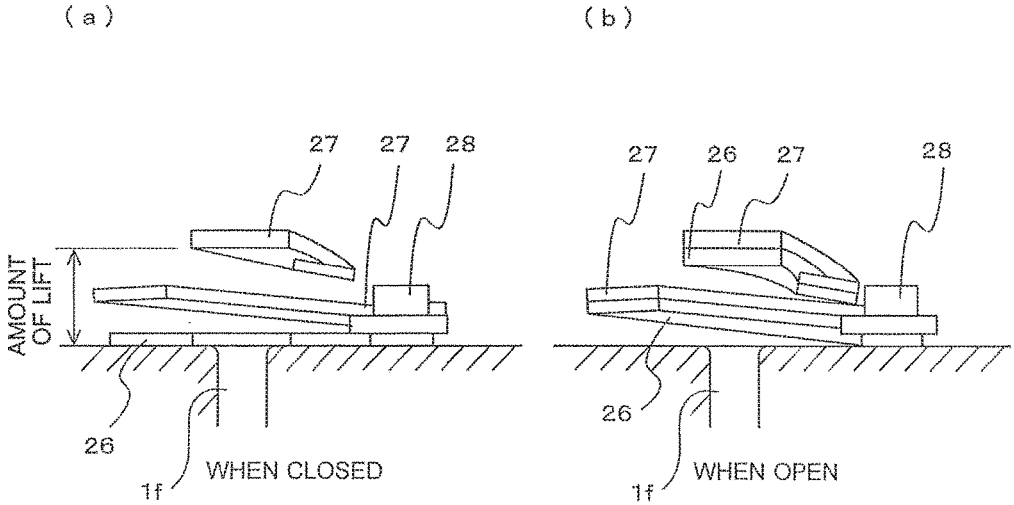
FIG. 5 includes side views of the discharge valve 26 of the fluid compressor 100 according to Embodiment 2 of the present invention closing and opening a discharge port 1*f*.

FIG. 5 includes side views of the discharge valve 26 of the fluid compressor 100 according to Embodiment 2 of the present invention closing and opening the discharge port 1*f*. FIG. 5(*a*) is the side view of the discharge valve 26 of the fluid compressor 100 according to Embodiment 2 of the present invention closing the discharge port 1*f*. FIG. 5(*b*) is the side view of the discharge valve 26 of the fluid compressor 100 according to Embodiment 2 of the present invention opening the discharge port 1*f*.

Before the fluid flowing in the closed container 20 is compressed in the compression chamber 23, the discharge port 1*f* is closed by the discharge valve 26 as illustrated in FIG. 5(*a*). After the fluid flowing in the closed container 20 is compressed in the compression chamber 23, the fluid compressed in the compression chamber 23 flows through the discharge port 1*f*. Then, as illustrated in FIG. 5(*b*), the discharge valve 26 warps along the curve of the valve retainer 27, thereby opening the discharge port 1*f*.

As described above, the fluid compressor 100 according to Embodiment 2 includes the discharge valve 26 having a helical or substantially helical shape. Consequently, the length of the discharge valve 26 from the fixed end to the free end can be made long. Hence, the curvature can be made large, and the amount of lift can also be made large. Thus, a compact fluid compressor 100 with a reduced pressure loss can be obtained.

Embodiment 3

Embodiment 3 differs from Embodiment 1 in that the discharge valve 26 includes a curved portion 26*a*, tongue portions 26*b*, and a connecting portion 26*c* and in that the valve retainer 27 has a rectangular shape in plan view.

Figure 6:
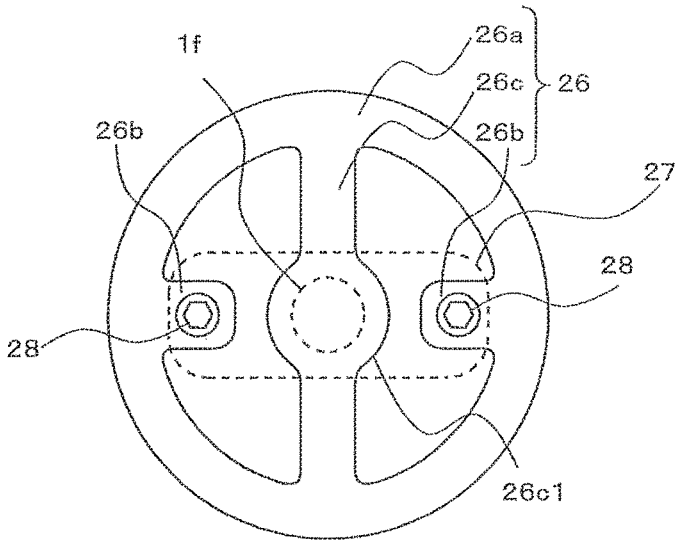
FIG. 6 is a top projection view of a discharge valve 26 and a valve retainer 27 of a fluid compressor 100 according to Embodiment 3 of the present invention.

FIG. 6 is a top projection view of a discharge valve 26 and a valve retainer 27 of a fluid compressor 100 according to Embodiment 3. As illustrated in FIG. 6, the discharge valve 26 includes, for example, a curved portion 26*a*, tongue portions 26*b*, and a connecting portion 26*c* and has open areas.

The curved portion 26*a* has, for example, an annular shape. The tongue portions 26*b* project inward from opposite positions on the inner periphery of the curved portion 26*a*, The connecting portion 26*c* connects other opposite positions on the inner periphery of the curved portion 26*a*, The connecting portion 26*c* extends in the diametrical direction of the curved portion 26*a*. The connecting portion 26*c* has a closing portion 26*c*1 at, for example, the center of the connecting portion 26*c*. The closing portion 26*c*1 is shaped to be able to close the discharge port 1*f*. The closing portion 26*c*1 has, for example, a shape swelling outward in the widthwise direction of the connecting portion 26*c*. The closing portion 26*c*1 is at a position toward which the tongue portions 26*b* project. The positions on the inner periphery of the curved portion 26*a* where the tongue portions 26*b* are provided are different by, for example, 90 degrees to the positions on the inner periphery of the curved portion 26*a* that are connected by the connecting portion 26*c*.

The valve retainer 27 is provided over a plane where the discharge port 1*f* can be closed. The discharge valve 26 and the valve retainer 27 are fixed to the fixed scroll 1 with two bolts 28. When the discharge valve 26 opens the discharge port 1*f*, the discharge valve 26 is lifted up to the bottom surface of the valve retainer 27.

Figure 7:
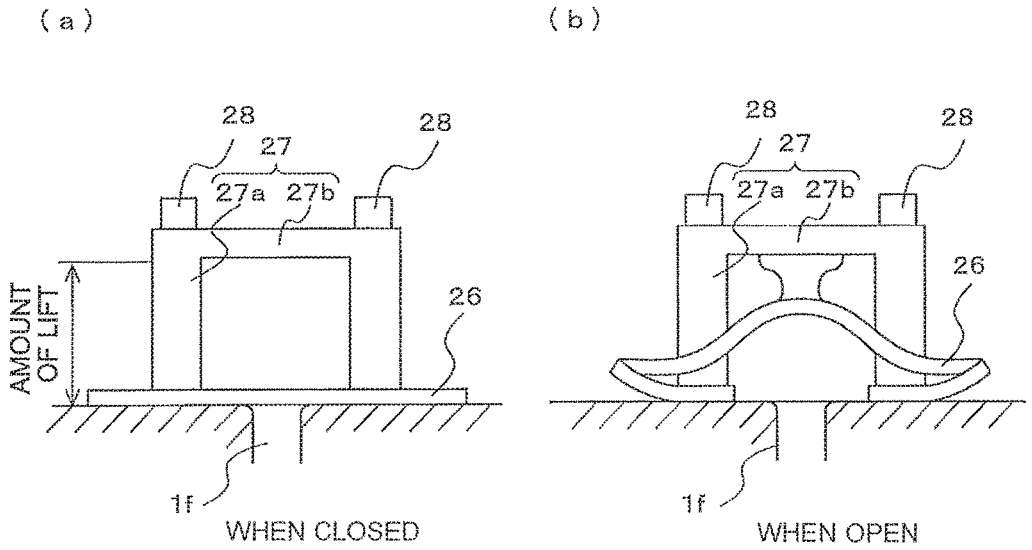
FIG. 7 includes side views of the discharge valve 26 of the fluid compressor 100 according to Embodiment 3 of the present invention closing and opening a discharge port 1*f*.

FIG. 7 includes side views of the discharge valve 26 of the fluid compressor 100 according to Embodiment 3 of the present invention closing and opening the discharge port 1*f*. FIG. 7(*a*) is the side view of the discharge valve 26 of the fluid compressor 100 according to Embodiment 3 of the present invention closing the discharge port 1*f*. FIG. 7(*b*) is the side view of the discharge valve 26 of the fluid compressor 100 according to Embodiment 3 of the present invention opening the discharge port 1*f*.

As illustrated in FIG. 7, the valve retainer 27 includes a pair of leg portions 27*a* and a top portion 27*b*. The pair of leg portions 27*a* extend, for example, vertically and parallel to each other. One of the leg portions 27*a* is provided above one of the tongue portions 26*b*. The other leg portion 27*a* is provided above the other tongue portion 26*b*. The top portion 27*b* connects the upper ends of the pair of leg portions 27*a*. The top portion 27*b* has, at two longitudinal ends, through holes (not illustrated) through which the bolts 28 extend. The discharge valve 26 and the valve retainer 27 are fixed to the fixed scroll 1 with the bolts 28.

Before the fluid flowing in the closed container 20 is compressed in the compression chamber 23, the discharge port 1*f* is closed by the discharge valve 26 as illustrated in FIG. 7(*a*). After the fluid flowing in the closed container 20 is compressed in the compression chamber 23, the fluid compressed in the compression chamber 23 flows through the discharge port 1*f*. Then, as illustrated in FIG. 7(*b*), the closing portion 26*c*1 of the discharge valve 26 warps upward until being stopped by the top portion 27*b* of the valve retainer 27, thereby opening the discharge port 1*f*.

As described above, the fluid compressor 100 according to Embodiment 3 includes the discharge valve 26 including the curved portion 26*a*, the tongue portions 26*b*, and the connecting portion 26*c*. Consequently, the length from each of the tongue portions 26*b* to the closing portion 26*c*1 can be made long. Hence, the curvature of the discharge valve 26 can be made large, and the amount of lift of the discharge valve 26 can also be made large. Thus, a compact fluid compressor 100 with a reduced pressure loss can be obtained. Furthermore, since the discharge valve 26 and the valve retainer 27 are fixed to the compression mechanism with the two bolts 28, the positioning work is not necessary in fastening the bolts 28. Consequently, the valve retainer 27 only needs to control the amount of lift of the closing portion 26*c*1. The discharge valve 26 can bend in various directions, thus the amount of lift of the discharge valve 26 can be increased without reducing the curvature of the discharge valve 26.

Embodiment 4

Embodiment 4 differs from Embodiment 1 in that the discharge valve 26 includes a curved portion 26*a* and a tongue portion 26*b* and in that the valve retainer 27 has a rectangular shape.

Figure 8:
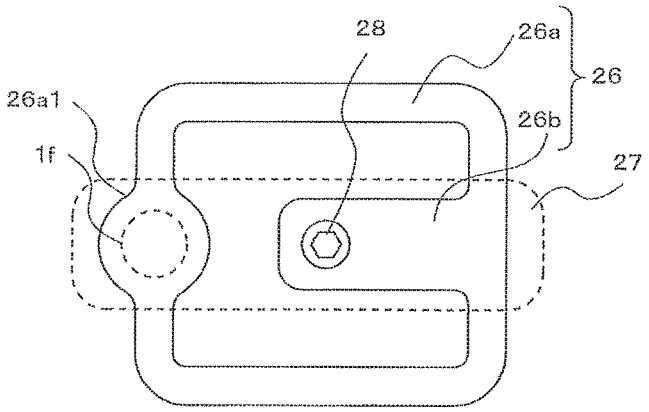
FIG. 8 is a top projection view of a discharge valve 26 and a valve retainer 27 of a fluid compressor 100 according to Embodiment 4 of the present invention.

FIG. 8 is a top projection view of a discharge valve 26 and a valve retainer 27 of a fluid compressor 100 according to Embodiment 4 of the present invention. As illustrated in FIG. 8, the discharge valve 26 includes, for example, a curved portion 26*a* and a tongue portion 26*b* and has an open area. The discharge valve 26 has, for example, a line-symmetrical shape to the curvature direction. The discharge valve 26 has, for example, an axially symmetrical shape to a line passing through the widthwise center of the tongue portion 26*b*.

The curved portion 26*a* has, for example, an annular shape. The curved portion 26*a* includes a closing portion 26*a*1 that closes the discharge port 1*f*. The tongue portion 26*b* projects inward from the position on the inner periphery of the curved portion 26*a* opposed to the closing portion 26*a*1. The tongue portion 26*b* has, at the tip of the tongue portion 26*b*, a part that is fixed with a bolt 28. The closing portion 26*a*1 is at a position toward which the tongue portion 26*b* projects. The closing portion 26*a*1 has a shape swelling inward and outward from the curved portion 26*a*.

The valve retainer 27 has a rectangular shape in plan view and is provided over a plane where the discharge port 1*f* can be closed. The discharge valve 26 and the valve retainer 27 are fixed to, for example, the fixed scroll 1 with the bolt 28. When the discharge valve 26 opens the discharge port 1*f*, the discharge valve 26 warps along the valve retainer 27 and is lifted up to the bottom surface of the valve retainer 27.

Figure 9:
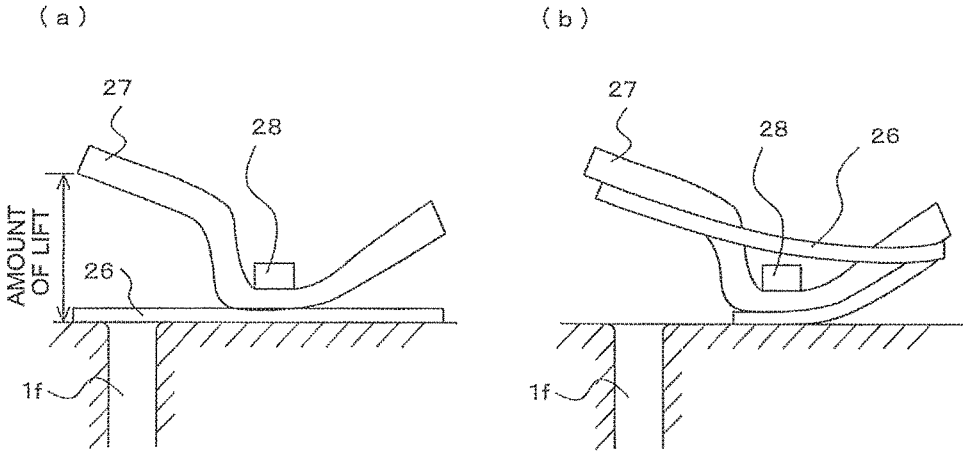
FIG. 9 includes side views of the discharge valve 26 of the fluid compressor 100 according to Embodiment 4 of the present invention closing and opening a discharge port 1*f*.

FIG. 9 includes side views of the discharge valve 26 of the fluid compressor 100 according to Embodiment 4 of the present invention closing and opening the discharge port 1*f*. FIG. 9(*a*) is the side view of the discharge valve 26 of the fluid compressor 100 according to Embodiment 4 of the present invention closing the discharge port 1*f* FIG. 9(*b*) is the side view of the discharge valve 26 of the fluid compressor 100 according to Embodiment 4 of the present invention opening the discharge port 1*f*.

As illustrated in FIG. 9, a part of the valve retainer 27 is shaped to be gradually raised from a position on the tongue portion 26*b* toward a position above the closing portion 26*a*1. Another part of the valve retainer 27 is shaped to be gradually raised in the direction opposite to the direction from the position on the tongue portion 26*b* to the position above the closing portion 26*a*1.

Before the fluid flowing in the closed container 20 is compressed in the compression chamber 23, the discharge port 1*f* is closed by the discharge valve 26 as illustrated in FIG. 9(*a*). After the fluid flowing in the closed container 20 is compressed in the compression chamber 23, the fluid compressed in the compression chamber 23 flows through the discharge port 1*f*. Then, as illustrated in FIG. 9(*b*), the discharge valve 26 warps along the curve of the valve retainer 27, thereby opening the discharge port 1*f*.

As described above, the fluid compressor 100 according to Embodiment 4 includes the discharge valve 26 including the curved portion 26*a* and the tongue portion 26*b*. Consequently, the length from the tongue portion 26*b* to the closing portion 26*a*1 can be made long. Thus, a compact fluid compressor 100 with a reduced pressure loss can be obtained. Furthermore, since the discharge valve 26 has a line-symmetrical shape to the curvature direction, the discharge valve 26 is not twisted when the discharge valve 26 is lifted. Thus, the increase in the stress due to torsion can be minimized. Furthermore, since the discharge valve 26 has an axially symmetrical shape to a line passing through the widthwise center of the tongue portion 26*b*, the position of the discharge valve 26 when the discharge valve 26 is lifted is laterally balanced. Consequently, the instability due to torsion can be eliminated, and design in consideration of torsional rigidity is unnecessary. Furthermore, since the discharge valve 26 and the valve retainer 27 are fixed to the fixed scroll 1 with one bolt 28, the number of components and thus the manufacturing costs can be reduced.

Furthermore, the present invention is also applicable to a fluid compressor in which a fluid compressed in a compression chamber is discharged to the lower side of the compression chamber. In this case, the discharge valve and the valve retainer are provided at the bottom of the fluid compressor so that the amount of fluid to be discharged from the compression chamber is limited as in the present invention. In such a configuration, a compact fluid compressor with reduced pressure loss at the discharge valve can be obtained as in the present invention.

REFERENCE SIGNS LIST

1 fixed scroll 1*a* end plate 1*b* first helical portion 1*f* discharge port 2 orbiting scroll 2*a* end plate 2*b* second helical portion 3 frame 4 main bearing 5 orbiting bearing 6 thrust plate 7 Oldham ring 8 electric-motor rotor 9 electric-motor stator 10 main shaft 10*a* eccentric shaft portion 10*b* pump shaft 10*c* oil hole 10*d*, 10*e* pivot portion 11 slider 11*a* slider surface 12 sleeve 13 upper balance-weight portion 14 lower balance-weight portion 15 sub-frame 15*a* bearing-receiving portion 16 sub-bearing 18 oil pump 19 oil sump 20 closed container 20*a* closed-container middle 20*b* closed-container bottom 20*c* closed-container top 21 inlet 22 outlet 23 compression chamber 24, 25 seal 26 discharge valve 26*a* curved portion 26*a*1 closing portion 26*b* tongue portion 26*c* connecting portion 26*c*1 closing portion 27 valve retainer 27*a* leg portion 27*b* top portion 28 bolt 100 fluid compressor

The invention claimed is:

1. A fluid compressor comprising:

a closed container having an inlet;

a compression mechanism including a compression chamber in which fluid flowing into the closed container through the inlet is compressed;

a discharge port through which the fluid compressed in the compression chamber is allowed to flow;

a discharge valve opening and closing the discharge port, the discharge valve including:

a curved portion having an annular shape defined by one or more curvatures, a tongue portion fixed to the compression mechanism and projecting inward from an inner periphery of the curved portion, and a closing part of the curved portion provided at a position toward which the tongue portion projects being positioned above the discharge port; and a valve retainer that includes a first end, a second end, and a middle section between the first end and the second end, the middle section of the valve retainer is directly attached to the tongue portion of the discharge valve, the first end of the valve retainer gradually extends from the middle section towards the discharge port and is spaced apart from the discharge port by a first height to delimit an amount of lift of the discharge valve when the discharge port is opened by the discharge valve, when the discharge port is closed by the discharge valve, the first end of the valve retainer and the discharge valve being spaced apart from each other by the first height.

2. The fluid compressor of claim 1, further comprising:

a fixed scroll including a first helical portion; and an orbiting scroll including a second helical portion whose whirling direction is opposite to a whirling direction of the first helical portion, wherein the compression chamber is provided by combining the fixed scroll and the orbiting scroll together so that the first helical portion and the second helical portion mesh with each other.

3. The fluid compressor of claim 1, wherein the closed container has an outlet through which refrigerant flowing out of the discharge port is allowed to flow.

4. The fluid compressor of claim 1, wherein the fluid is R32 refrigerant or a refrigerant mixture containing the R32 refrigerant by 51% or higher.

5. The fluid compressor of claim 4, wherein, when the fluid is the refrigerant mixture containing the R32 refrigerant by 51% or higher, refrigerant contained in the refrigerant mixture other than the R32 refrigerant is at least one of R125 and R161, at least one of HFO-1234yf, HFO-1234ze, and HFO-1243zf, or at least one of propane and propylene.

6. The fluid compressor of claim 1, wherein the fluid is single refrigerant of HFO-1234yf refrigerant containing carbon double bonds, single refrigerant of HFO-1234ze refrigerant containing carbon double bonds, a refrigerant mixture containing the HFO-1234yf refrigerant by 30% or higher, or a refrigerant mixture containing the HFO-1234ze refrigerant by 30% or higher.

7. The fluid compressor of claim 1, wherein the fluid is a refrigerant mixture containing HFO-1123 refrigerant containing carbon double bonds by 70% or lower.

8. The fluid compressor of claim 1, wherein the valve retainer is fixed to the compression mechanism together with the discharge valve at the tongue portion, and wherein a part of the valve retainer is shaped to be raised in a direction opposite to the direction from the position on the tongue portion toward the position above the discharge port.

* * * * *